US008299427B2

(12) United States Patent
Mukaibatake

(10) Patent No.: US 8,299,427 B2
(45) Date of Patent: Oct. 30, 2012

(54) MASS SPECTROMETER

(75) Inventor: Kazuo Mukaibatake, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 115 days.

(21) Appl. No.: 12/522,841

(22) PCT Filed: Jan. 23, 2007

(86) PCT No.: PCT/JP2007/050939

§ 371 (c)(1),
(2), (4) Date: Jul. 10, 2009

(87) PCT Pub. No.: WO2008/090600

PCT Pub. Date: Jul. 31, 2008

(65) Prior Publication Data

US 2010/0059675 A1 Mar. 11, 2010

(51) Int. Cl.
*H01J 49/00* (2006.01)

(52) U.S. Cl. ..... 250/288

(58) Field of Classification Search ..... 250/281, 250/287, 294, 385.1, 288, 306, 290, 292
See application file for complete search history.

(56) References Cited

U.S. PATENT DOCUMENTS 5,291,016 A * 3/1994 Taya ..... 250/292
5,847,386 A * 12/1998 Thomson et al. ..... 250/288
6,373,052 B1 4/2002 Hoyes et al.
6,674,071 B2 * 1/2004 Franzen et al. ..... 250/292
7,060,987 B2 6/2006 Lee et al.
7,495,212 B2 * 2/2009 Kim et al. ..... 250/292
2003/0136905 A1 * 7/2003 Franzen et al. ..... 250/292
2004/0227070 A1 * 11/2004 Bateman et al. ..... 250/287
2008/0265154 A1 * 10/2008 Cousins et al. ..... 250/288
2009/0134321 A1 * 5/2009 Hoyes ..... 250/282
2010/0096541 A1 * 4/2010 Okumura et al. ..... 250/281
2010/0171035 A1 * 7/2010 Okumura et al. ..... 250/289

FOREIGN PATENT DOCUMENTS

JP 2000-513494 A 10/2000
JP 2006-521006 A 9/2006

* cited by examiner

*Primary Examiner* — Robert Kim
*Assistant Examiner* — Jason McCormack
(74) *Attorney, Agent, or Firm* — Sughrue Mion, PLLC

(57) ABSTRACT

An object of the present invention is to provide a mass spectrometer having an optical ion transport system where the efficiency for generating and converting fragment ions can be increased, and which can transport the generated fragment ions efficiently to the rear stage, and in order to achieve this object, the mass spectrometer for ionizing a sample in an ionization chamber 10 and drawing the ionized sample into a mass spectrometric chamber 18 is provided with an ion transport optical system having electrodes 17, 200-1 and 200-2 provided so as to surround an optical ion axis, and is characterized in that the above described electrodes 17, 200-1 and 200-2 have an inclined surface which is inclined so as to spread in the direction in which ions progress along the above described optical ion axis.

5 Claims, 9 Drawing Sheets

(a)

(b)

(a)

(b)

(a)

(b)

MASS SPECTROMETER

TECHNICAL FIELD

The present invention relates to a mass spectrometer (MS), and in particular, to a mass spectrometer for ionizing liquid samples.

BACKGROUND ART

In the case where a liquid sample with components separated through liquid chromatography (LC) or the like is introduced in a mass spectrometer (MS) and detected, an ionization method, for example an atmospheric pressure chemical ionization method (APCI), and an electrospray method (ESI) is used in an ionization chamber. According to ionization methods, a liquid sample is ionized under pressure close to atmospheric pressure and thus, a middle chamber or the like is provided between an ionization chamber, where the pressure is high (that is, close to atmospheric pressure), and a mass spectrometric chamber under very low pressure (that is to say, close to a high vacuum), in order to secure a difference in pressure between the two chambers, so that a configuration where the degree of vacuum is increased in increments can be adopted.

According to such ionization methods, however, various types of fragment ions are not generated, as in electron impulse type ionization methods used for gas samples, and mainly ions having some relation to the molecular weight of sample molecules are generated, and therefore, information on the molecular weight of the liquid sample can be acquired in the mass spectrometric chamber, but almost no information can be acquired on the molecular structure of the liquid sample. As a result, a tandem mass spectrometer (MS/MS) is used as a mass spectrometer, and a collision chamber is provided between the two mass spectrometric chambers, and thus, ions having some relation to the molecular weight and collision gas collide in the collision chamber, so that a splitting reaction is induced in the ions having some relation to the molecular weight, and consequently, various types of fragment ions are generated, and as a result, information on the molecular structure of the liquid sample can be acquired in the mass spectrometric chamber in the rear stage.

In addition, a liquid chromatographic mass spectrometer having a collision cell where a quadrupole is provided inside the collision chamber has also been disclosed (see for example Patent Document 1).

FIG. 11 is a schematic diagram showing the configuration of an example of an electrospray mass spectrometer (ESI-MS), and FIG. 12 is a diagram showing the collision cell in FIG. 11. The ESI-MS is formed of an ionization chamber 10 where a nozzle 11 is provided and connected to the outlet end of the column of the liquid chromatographic unit, a first vacuum chamber 12, a second vacuum chamber 100 and a third vacuum chamber (mass spectrometric chamber) 18. A collision cell 31 is provided between a quadrupole filter 19-1 and a quadrupole filter 19-2.

In addition, a means for aiding ion transportation, referred to as ion ring or ion guide, which is provided so as to externally touch a circle having an optical ion axis as the axis (diameter: d1), is used in the first vacuum chamber 12 and the second vacuum chamber 100 in order to transport ions efficiently to the rear stage.

Furthermore, the ionization chamber 10 and the first vacuum chamber 12 are connected only through a desolvation pipe (heated capillary) 13 having a small diameter, and the first vacuum chamber 12 and the second vacuum chamber 100 are connected only through a skimmer 16 in conical form having a circular hole (orifice) 16*a* having a small diameter at the apex.

In addition, the second vacuum chamber 100 and the third vacuum chamber 18 are also connected only through a circular hole (orifice) 23*a* having a small diameter.

The collision cell 31 provided within the third chamber 18 is separated from the third vacuum chamber 18 by partitions 300-1 and 300-2 having circular holes (orifices) 300-l*a* and 300-2*a* having a small diameter. Here, the circular holes 300-l*a* and 300-2*a* are created in a plane forming an angle of 90 degrees with the direction in which ions progress.

Thus, a liquid sample is electrosprayed in the ionization chamber 10 through a nozzle 11, so that the sample molecules are ionized during the process in which the solvent in liquid drops evaporates. The microscopic liquid drops into which ions are mixed are drawn into the desolvation pipe 13 due to the difference in pressure between the ionization chamber 10 and the first vacuum chamber 12, so that the solvent evaporates during the process through which the liquid drops pass through the desolvation pipe 13 so as to be further ionized. A facing ion guide (also referred to as "ion lens" or "ion transport lens") 14 is provided inside the first vacuum chamber 12, and an electrical field generated by the ion guide 14 aids the drawing in of ions through the desolvation pipe 13, and at the same time, ions converge in the vicinity of the orifice 16*a* (optical ion axis) of the skimmer 16.

Ions that pass through the orifice 16*a* due to the difference in pressure between the first vacuum chamber 12 and the second vacuum chamber 100 enter the second vacuum chamber 100, and furthermore, ions that pass through the orifice 23*a* due to the difference in pressure between the second vacuum chamber 100 and the third vacuum chamber 18 enter the third vacuum chamber 18.

A quadrupole filter 19-1 to which a voltage where a direct current voltage and a high-frequency voltage overlap is applied allows ions having a mass number (mass m/charge z) in accordance with the applied voltage to selectively pass within the third vacuum chamber 18.

Ions pass through the quadrupole filter 19-1 and then enter the collision cell 31.

An ion guide (also referred to as "ion lens" or "ion transport lens") 37 is provided inside the collision cell 31, and ions accelerate as a result of the high frequency electrical field generated by the ion guide 37, and at the same time, the ions vibrate at a predetermined frequency while progressing so as to converge in the vicinity of the orifice 300-2*a* (optical ion axis) in the partition 300-2. At this time, a collision gas, such as He or Ar, is introduced into the collision cell 31 from an external gas reserve 26, so that ions and the collision gas collide, and various types of fragment ions are generated from the ions.

Ions that pass through the collision cell 31 (fragment ions) enter the quadrupole filter 19-2.

The operation of the quadrupole filter 19-2 is the same as for the quadrupole filter 19-1, and a quadrupole filter 19-2 to which a voltage where a direct current voltage and a high-frequency voltage overlap is applied allows ions having a mass number (mass m/charge z) in accordance with the applied voltage to selectively pass through.

As a result, ions that selectively pass through the quadrupole filter 19-2 reach an ion detector 20.

Here, the main working effects of the ion guide 37 are to cause flying ions to converge using an electrical field, in some cases to accelerate, and, various different types of ion guides have been proposed. One of these ion guides 37 is a so-called multi-pole type ion guide, where an even number of electrodes in columnar form which extend in the direction of the optical ion axis are provided at a distance from each other so as to externally touch the circle having an optical ion axis as the axis. In this multiple type ion guide, voltages where high-frequency voltages with a reversed phase overlap with the same direct current voltage (in other words, high-frequency voltages biased as a direct current) are applied to electrodes in columnar form which are adjacent along the circumference. As a result, the generated high-frequency electrical field allows ions introduced into the ion guide to progress while vibrating with a predetermined period, as well as to be transported efficiently to the rear stage.

In addition, in another example of an ion guide 37, a collective body of oval electrodes is used instead of electrodes in columnar form.

Patent Document 1: U.S. Pat. No. 4,234,791

DISCLOSURE OF THE INVENTION

Problem to Be Solved by the Invention

In the ESI-MS shown in FIGS. 11 and 12, however, the efficiency for generating fragment ions, i.e., collision induced dissociation (CID) efficiency, is not ideal.

Therefore, an object of the present invention is to provide a mass spectrometer having an optical ion transport system where the efficiency for generation and conversion of fragment ions and which can transport generated fragment ions efficiently to the rear stage.

Means for Solving Problem

The present inventors examined the relationship between the form of the ion guide and the orifice and the distribution of the potential in order to solve the above described problem.

Thus, the orifice in the collision cell is formed so as to have an inclined surface which is inclined in such a manner that the orifice spreads in the direction in which ions progress along the optical axis, and the distribution of the potential is such that it protrudes in the direction in which ions progress along the optical axis, as shown in FIG. 3. It was found that as a result fragment ions can be transported efficiently to the rear stage.

That is to say, the mass spectrometer according to the present invention is a mass spectrometer for ionizing a sample in an ionization chamber and drawing the ionized sample into a mass spectrometric chamber provided with an ion transport optical system having electrodes provided so as to surround an optical ion axis, and is characterized in that the above described electrodes have an inclined surface which is inclined so as to spread in the direction in which ions progress along the above described optical ion axis.

In the mass spectrometer according to the present invention, the electrodes have an inclined surface which is inclined so that the surface spreads in the direction in which ions progress along the optical ion axis, and therefore, the distribution of the potential is such that it protrudes in the direction in which ions progress along the optical axis. Therefore, fragment ions can be efficiently detected. That is to say, information can be acquired on the molecular structure of a liquid sample.

(Other Means for Solving the Problem and Effects)

In addition, in the mass spectrometer according to the present invention, the above described electrodes are electrodes which form an ion guide.

Furthermore, in the mass spectrometer according to the present invention, the above described electrodes are electrodes provided within a collision cell into which a collision gas is supplied.

Moreover, in the mass spectrometer according to the present invention, the above described electrodes form a partition in a collision cell and have a small hole along the above described optical ion axis, and a surface in conical form which is inclined so that the surface spreads in the direction in which ions progress along the above described optical ion axis.

EXPLANATION OF SYMBOLS

10 ionization chamber
17, 37, 200-1, 200-2 ion guides
18 mass spectrometric chamber

BEST MODE FOR CARRYING OUT THE INVENTION

In the following, the embodiments of the present invention are described in reference to the drawings. Here, the present invention is not limited to the following embodiments, and various modifications may, of course, be included, provided that they be within such scope as not to deviate from the gist of the present invention.

Figure 1:
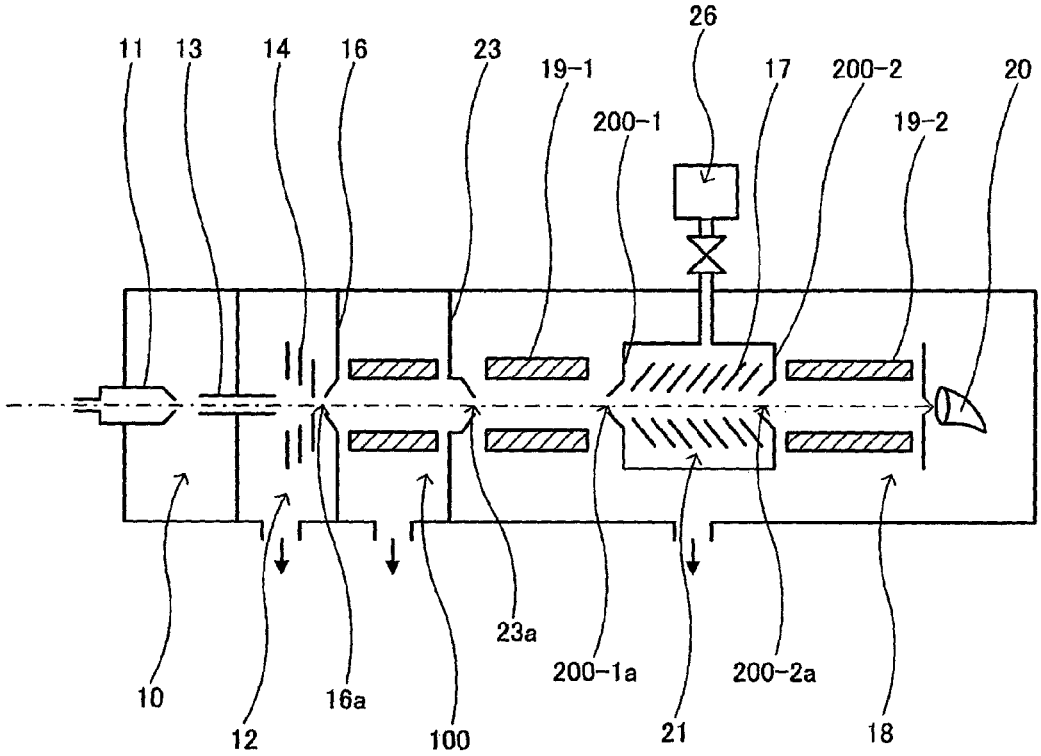
FIG. 1 is a schematic diagram showing an example of the configuration of the mass spectrometer according to the present invention.
Figure 2:
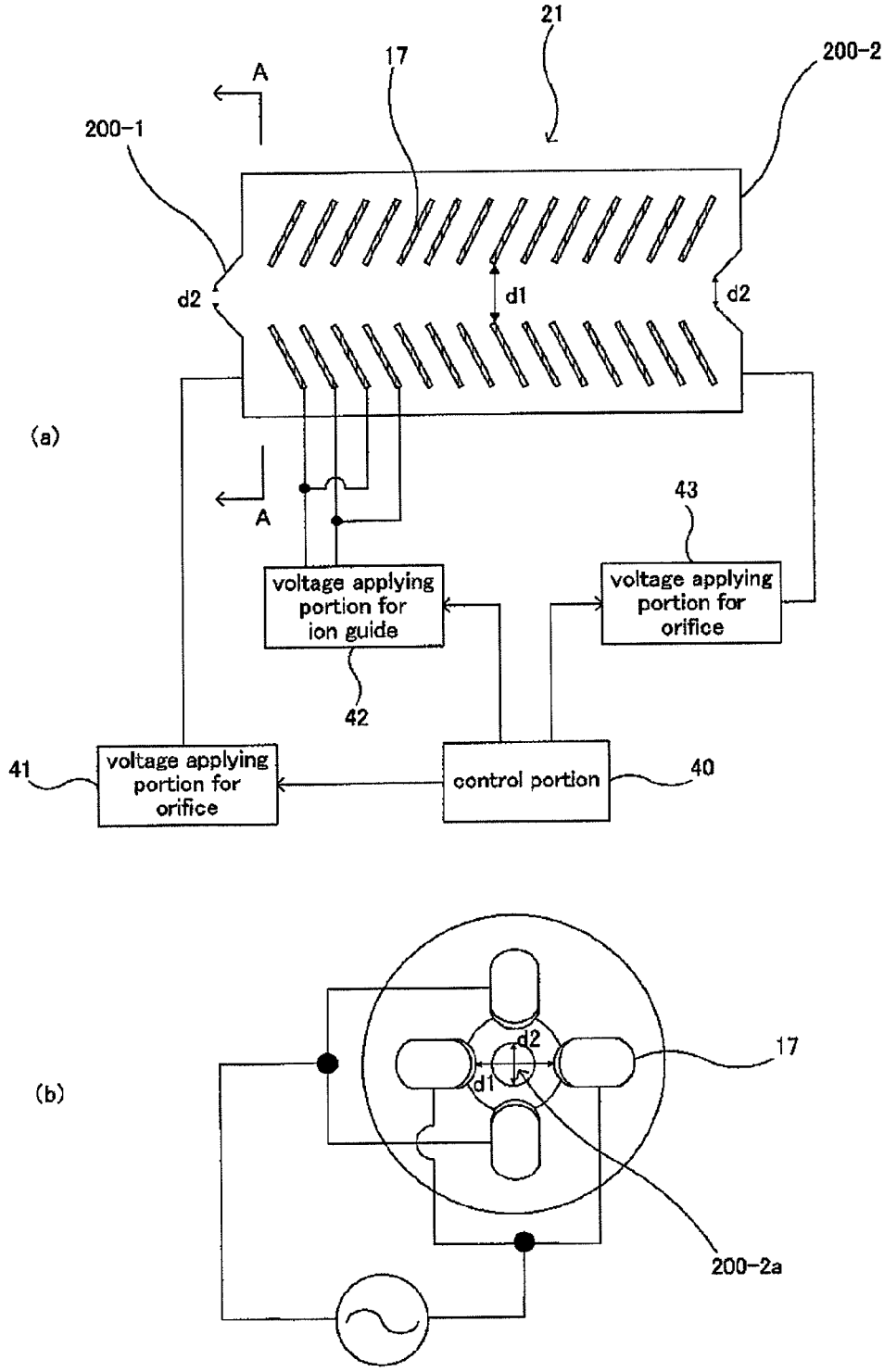
FIG. 2 is a diagram showing the collision cell in FIG. 1.

FIG. 1 is a diagram schematically showing an example of the configuration of the mass spectrometer according to the present invention. FIG. 2 is a diagram showing the collision cell in FIG. 1. Here, the same symbols are used for components which are the same as in the above described ESI-MS, and descriptions are not repeated. In addition, part of the configuration is omitted in FIG. 1 for the sake of simplicity.

The mass spectrometer shown in FIG. 1 is provided with an ionization chamber 10 having a nozzle 11 which is connected to the outlet end of the column of the liquid chromatograph unit, a first vacuum chamber 12 where a means for aiding ion transportation which is placed so as to externally touch the circle having the optical ion axis as the axis (diameter: d1) in order to efficiently transport ions to the rear stage, referred to as "ion ring" or "ion guide" is used, a second vacuum chamber 100, and a mass spectrometric chamber 18, which is a third vacuum chamber having a quadrupole filter 19-1, a collision cell 21, a quadrupole filter 19-2 and an ion detector 20.

The vacuum chambers are separated from each other by partitions, and the collision cell placed inside the third vacuum chamber 18 is also sectioned by partitions 200-1 and 200-2.

Voltage applying portions for an orifice 41 and 43 which are controlled by a control portion (computer) 40 are connected to the partitions 200-1 and 200-2 of the collision cell 21, and a voltage applying portion for an ion guide 42 which is controlled by the control portion (computer) 40 is connected to the ion guide 17 inside the collision cell 21.

The quadrupole filter 19-1 is connected to the inside of the collision cell 21 only through the partition 200-1 in conical form having a circular hole (orifice) 200-1*a* with a small diameter at the apex. Here, the diameter (d2) of the circular hole 200-1*a* is smaller than the diameter d1, and the surface in conical form is formed so as to be inclined so that the surface spreads in the direction in which ions progress along the optical axis (see FIG. 2). In addition, a direct current voltage is applied to the partition 200-1 from the voltage applying portion for an orifice 41.

In addition, the inside of the collision cell 21 is connected to the quadrupole filter 19-2 only through the partition 200-2 in conical form having a circular hole (orifice) 200-2*a* with a small diameter at the apex. Here, the diameter (d2) of the circular hole 200-2*a* is smaller than the diameter d1, and the surface in conical form is formed so as to be inclined so that the surface spreads in the direction in which ions progress along the optical axis (see FIG. 2). In addition, a direct current voltage is applied to the partition 200-2 from the voltage applying portion for an orifice 43.

The inside of the ionization chamber 10 has approximately atmospheric pressure, due to the molecules of the liquid sample continuously supplied from the nozzle 11 evaporating, while the inside of the first middle chamber 12 is in a low vacuum state of approximately $10^2$ Pa, due to air being discharged by a rotary pump. In addition, the inside of the second middle chamber 100 is in a middle vacuum state of approximately $10^{-1}$ Pa to $10^{-2}$ Pa, due to air being discharged by a turbo molecular pump, and the inside of the mass spectrometric chamber 18 in a high vacuum state of approximately $10^{-3}$ Pa to $10^{-4}$ Pa, due to air being discharged by a turbo molecular pump. That is to say, the closer the chamber is located to the mass spectrometric chamber 18 and the farther from the ionization chamber 10, the higher the degree of vacuum is.

The ion guide 17 is made up of four quadrupole electrodes provided separately from each other and externally touching the circle having the optical ion axis as the axis (diameter: d1). One electrode is formed of a collective body where oval electrodes are aligned in a line with constant intervals, and in each electrode, the oval electrodes are parallel to each other and inclined so as to spread relative to the direction in which ions progress along the optical axis (see FIG. 2). Here, the lines connecting the center of the oval electrodes are parallel to the optical ion axis.

In addition, the four electrodes that form the ion guide 17 are connected to the voltage applying portion for an ion guide 42 (here, FIG. 2 only shows part of the structure for the sake of simplicity). In addition, high-frequency voltages having opposite phases are applied to adjacent electrodes in the direction of the circumference. Furthermore, individual direct current voltages are applied to the oval electrodes in each electrode.

In this configuration, ions that pass through the quadrupole filter 19-1 enter the collision cell 21. The ion guide 17 is provided inside the collision cell 21, so that ions accelerate as a result of the high-frequency electrical field generated by the ion guide 17, and at the same time vibrate with a predetermined period while progressing so as to converge in the vicinity of the orifice 200-2*a* in the partition 200-2 (optical ion axis). At this time, a collision gas, such as He or Ar, is introduced into the collision cell 21 from an external gas reserve 26, so that the ions and the collision gas collide and various types of fragment ions are generated from the ions, and at the same time, the potential distribution is such that it protrudes in the direction in which ions progress along the optical axis, due to the ion guide 17 and the partitions 200-1 and 200-2 having an inclined surface which is inclined so as to spread relative to the direction in which the ions progress along the optical axis, and thus, the fragment ions can be transported efficiently to the rear stage.

After that, ions (fragment ions) which pass through the orifice 200-2*a* are guided to the quadrupole filter 19-2. Ions having a mass number (mass m/charge z) in accordance with the applied voltage selectively pass through the quadrupole filter 19-2 to which a voltage where a direct current voltage and a high frequency voltage overlap is applied, and therefore, the selected ions reach the ion detector 20. At this time, the mass number of ions which pass through the quadrupole filter 19-2 depends on the applied voltage, and therefore, an ion intensity signal for ions having a predetermined mass number can be gained in the ion detector 10 by scanning the applied voltage. Here, the output of the ion detector 10 is inputted into the control portion 40.

As described above, in the mass spectrometer according to the present invention, the electrodes have an inclined surface which is inclined so as to spread relative to the direction in which ions progress along the optical axis, and therefore, the distribution of the potential is such that it protrudes in the direction in which ions progress along the optical axis. Accordingly, the efficiency with which fragment ions are generated and converted can be increased, so that fragment ions can be detected efficiently. That is to say, information can be acquired on the molecular structure of the liquid sample.

Here, the results of examination on the relationship between the form of the electrodes and the distribution of the potential are shown.

Figure 3:
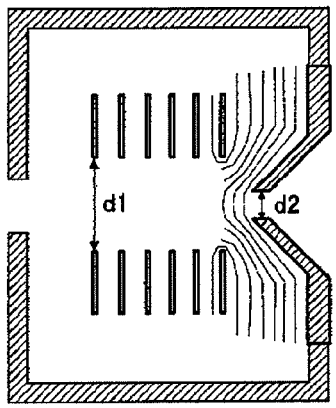
FIG. 3 is a diagram showing part of the distribution of the potential around the ion guide and the orifice in the collision cell in the mass spectrometer according to the present invention.
Figure 4:
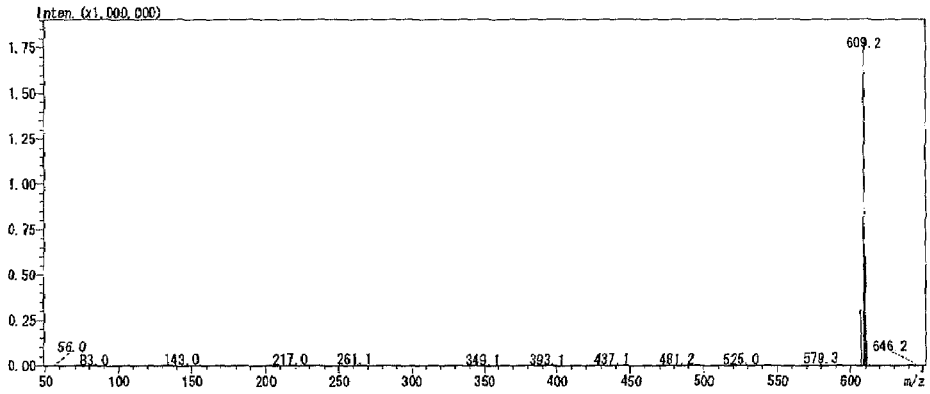
FIG. 4 is mass spectra gained in the collision cell in FIG. 3.
Figure 4:
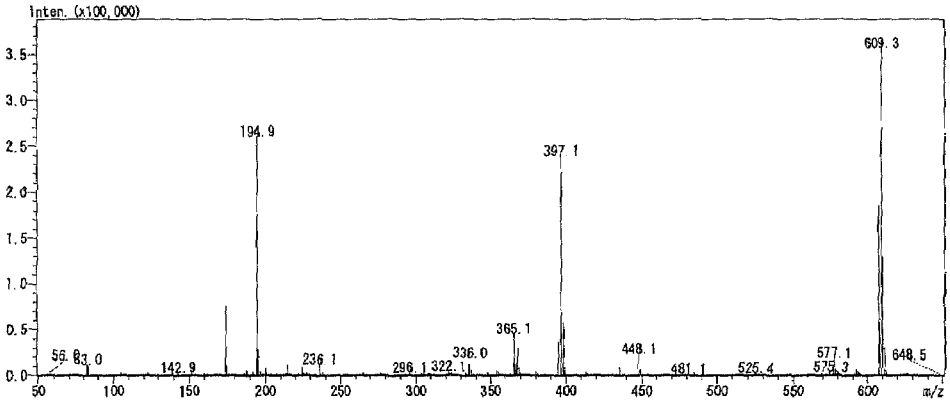

FIGS. 4(*a*) and 4(*b*) are mass spectra gained using an ESI-MS having the configuration shown in FIG. 3. FIG. 4(*a*) is a mass spectrum in a normal state, and FIG. 4(*b*) is a mass spectrum in a fragmented state. Here, "normal state" means that no collision energy is provided, while "fragmented state" means that collision energy is provided. In addition, reserpine was used as a sample, and the mass spectrum was gained with an optimal voltage for the collision energy.

Figure 5:
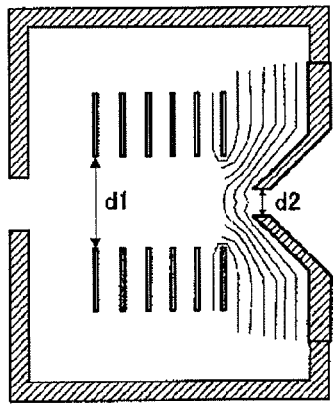
FIG. 5 is a diagram showing part of the distribution of the potential around the ion guide and the orifice in the collision cell in another mass spectrometer according to the present invention.
Figure 6:
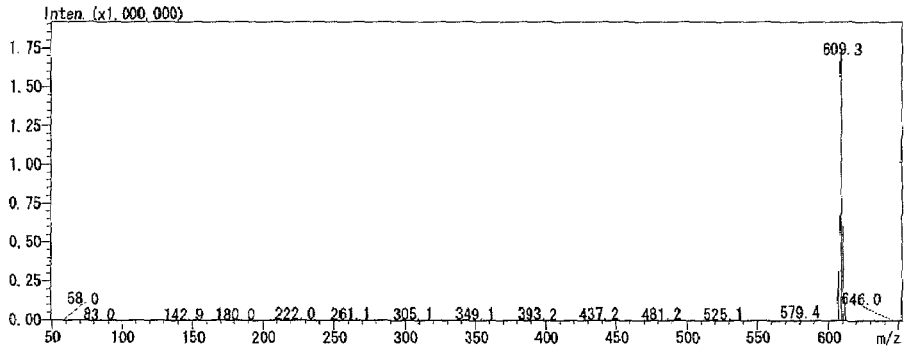
FIG. 6 is mass spectra gained in the collision cell in FIG. 5.
Figure 6:
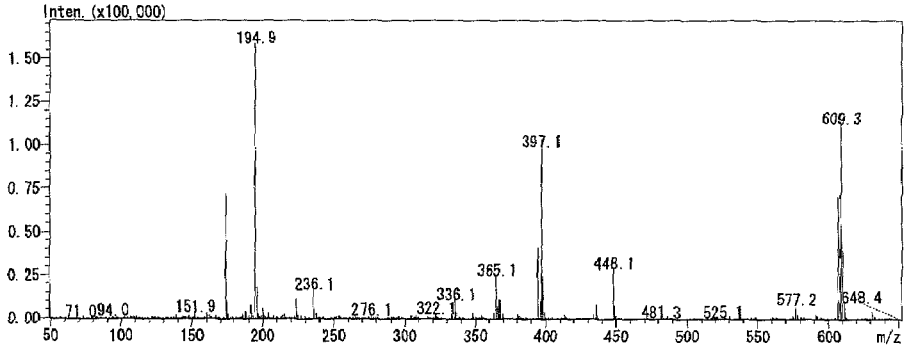

In addition, FIGS. 6(*a*) and 6(*b*) are mass spectra gained using an ESI-MS having the configuration shown in FIG. 5. FIG. 6(*a*) is a mass spectrum in a normal state, and FIG. 6(*b*) is a mass spectrum in a fragmented state.

Figure 7:
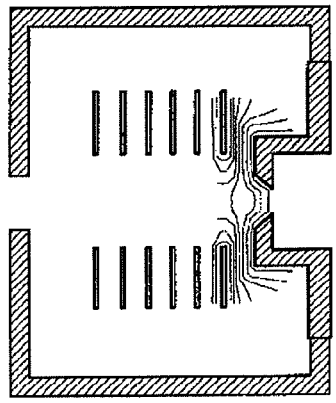
Prior Art Fig.7
FIG. 7 is a diagram showing part of the distribution of the potential around the ion guide and the orifice in the collision cell in a mass spectrometer.
Figure 8:
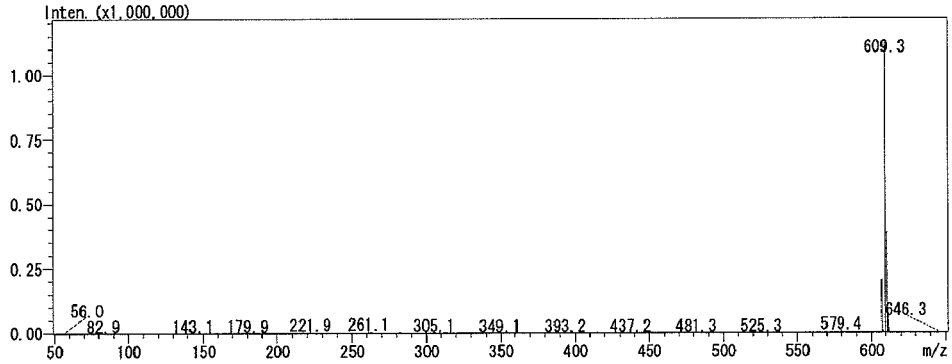
FIG. 8 is mass spectra gained in the collision cell in FIG. 7.
Figure 8:
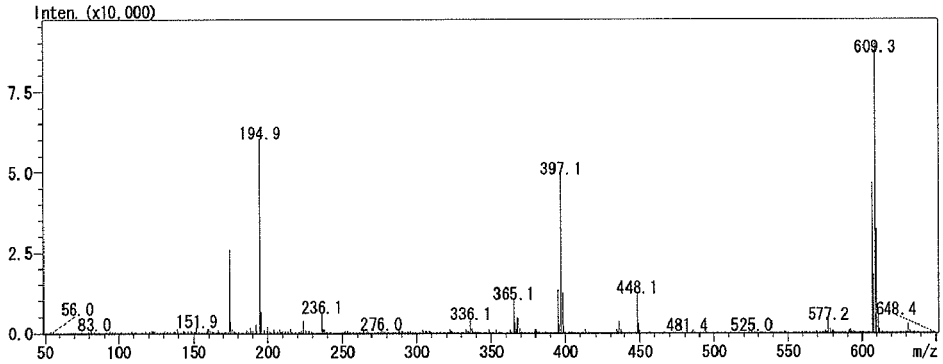

Furthermore, FIGS. 8(*a*) and 8(*b*) are mass spectra gained using an ESI-MS having the configuration shown in FIG. 7. FIG. 8(*a*) is a mass spectrum in a normal state, and FIG. 8(*b*) is a mass spectrum in a fragmented state.

In the ESI-MS having the configuration shown in FIG. 3, the distribution of the potential is such that it protrudes in the direction in which ions progress, and as shown in FIGS. 4(*a*) and 4(*b*), the CID efficiency ((intensity of m/z195 in fragmented state)/(intensity of m/z609 in normal state))×100 is as good as 15.0%. In addition, in the ESI-MS having the configuration shown in FIG. 5, the distribution of the potential is such that it protrudes at least partially in the direction in which ions progress, and as shown in FIGS. 6(*a*) and 6(*b*), the CID efficiency ((intensity of m/z195 in fragmented state)/(intensity of m/z609 in normal state))×100 is as good as 8.8%.

Meanwhile, in the ESI-MS having the configuration shown in FIG. 7, the distribution of the potential is such that it does not protrude in the direction in which ions progress. As shown in FIGS. 8(*a*) and 8(*b*), in the configuration shown in FIG. 7, the CID efficiency ((intensity of m/z195 in fragmented state)/(intensity of m/z609 in normal state))×100 is 5.4%, which is lower than in the configuration shown in FIGS. 3 and 5.

(Other Embodiments)

Figure 9:
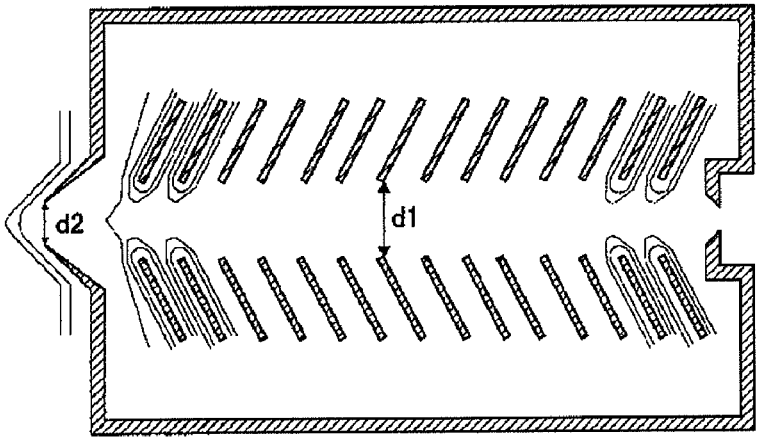
FIG. 9 is a schematic diagram showing another example of the configuration of the collision cell in the mass spectrometer according to the present invention.

(1) Though in the above described mass spectrometer, a partition 200-2 in conical form having a circular hole 200-2*a* with a small diameter is used in the collision cell 21, a partition in columnar form having a plane with a circular hole with a small diameter may be used in the configuration (see FIG. 9).

Figure 10:
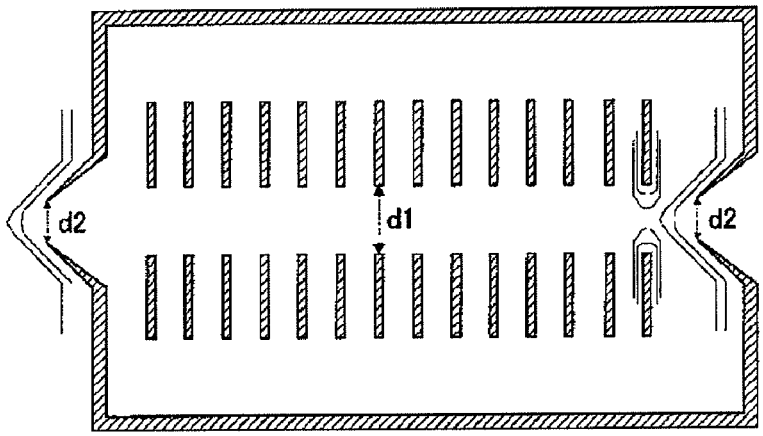
FIG. 10 is a schematic diagram showing yet another example of the configuration of the collision cell in the mass spectrometer according to the present invention.
Figure 11:
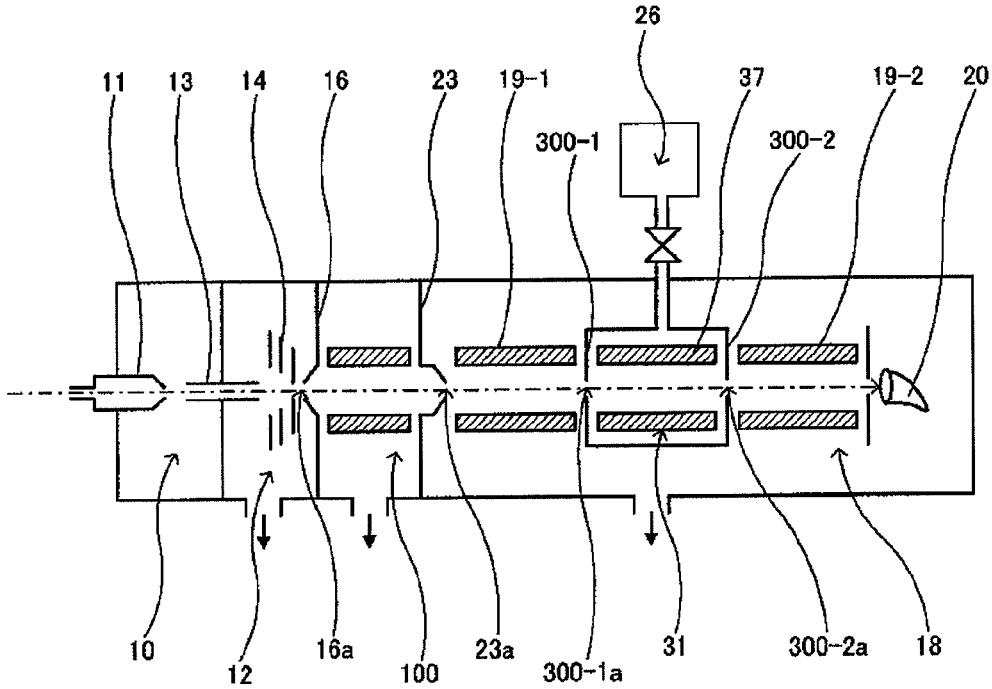
Fig.11 Prior Art
FIG. 11 is a schematic diagram showing an example of the configuration of a conventional electrospray mass spectrometer.
Figure 12:
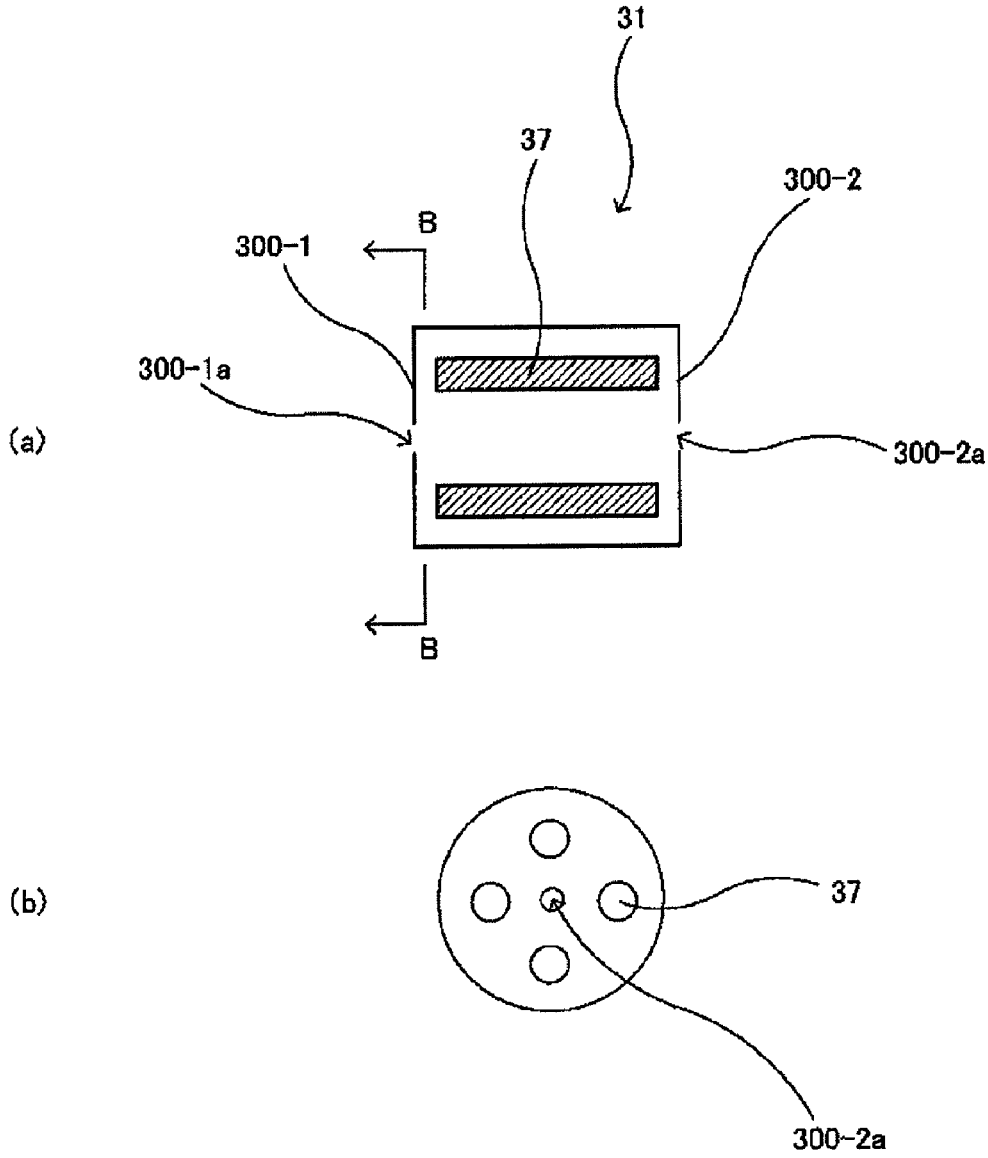
Fig.12 Prior Art
FIG. 12 is a diagram showing the collision cell in FIG. 11.

(2) Though in the above described mass spectrometer, the oval electrodes are inclined so as to spread in the direction in which ions progress along the optical axis, the oval electrodes may be perpendicular to the direction in which ions progress along the optical axis in the configuration (see FIG. 10).

INDUSTRIAL APPLICABILITY

The present invention can be used for liquid chromatograph mass spectrometers; specifically those for ionizing liquid samples.

The invention claimed is:

1. A mass spectrometer for ionizing a sample in an ionization chamber and drawing the ionized sample into a mass spectrometric chamber, comprising an ion transport optical system having a plurality of collective bodies provided so as to surround an optical ion axis, characterized in that each collective body is formed of a plurality of electrodes that are aligned in a line at constant intervals, within each collective body, said electrodes are parallel to each other and each of the electrodes is respectively inclined so as to spread in the direction in which ions progress along said optical ion axis, and voltages having opposite phases are respectively applied to adjacent collective bodies.

2. The mass spectrometer according to claim 1, wherein the collective bodies form an ion guide.

3. The mass spectrometer according to claim 1, wherein the collective bodies are provided within a collision cell into which a collision gas is supplied.

4. The mass spectrometer according to claim 1, further comprising further electrodes that form a partition in a collision cell and have a hole along said optical ion axis, and a surface in conical form which is inclined so that the surface spreads in the direction in which ions progress along said optical ion axis.

5. The mass spectrometer according to claim 1, wherein the collective bodies extend is a direction parallel to the optical ion axis.

* * * * *